US006260687B1

(12) United States Patent
Ulrich

(10) Patent No.: US 6,260,687 B1
(45) Date of Patent: Jul. 17, 2001

(54) EQUIPMENT AND METHOD FOR SIMPLIFIED ROLLER BEARING EXCHANGE AT ESCALATORS AND MOVING WALKWAYS

(75) Inventor: Robert Ulrich, Bruckneudorf (AT)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 09/482,750

(22) Filed: Jan. 13, 2000

(30) Foreign Application Priority Data

Jan. 13, 1999 (EP) ..... 99 810018

(51) Int. Cl.[7] ..... B66B 21/00
(52) U.S. Cl. ..... 198/330; 198/331
(58) Field of Search ..... 198/330, 331, 198/866

(56) References Cited

U.S. PATENT DOCUMENTS 4,535,880 * 8/1985 Botrek ..... 198/330
4,674,619 * 6/1987 Nakazawa et al. ..... 198/331
4,775,044 * 10/1988 Hofling ..... 198/330
5,131,521 * 7/1992 Johnson et al. ..... 198/335
5,950,797 * 9/1999 Aulanko et al. ..... 198/330

FOREIGN PATENT DOCUMENTS 1 230 270 * 4/1971 (GB) .

* cited by examiner

*Primary Examiner*—Christopher P. Ellis
*Assistant Examiner*—Rashmi Sharma
(74) *Attorney, Agent, or Firm*—Schweitzer Cornman Gross & Bondell LLP

(57) ABSTRACT

An apparatus for exchanging roller bearings of escalator and moving walkway chainwheel sub-assemblies includes the provision of auxiliary supports to which the chainwheel sub-assembly can be fixed. With removal of axle carriers the central axle becomes accessible, and can be displaced laterally to disengage from one of the roller bearings, which is subsequently removed and replaced. The central axle is then displaced in the opposite direction to allow access to an opposite roller bearing. Auxiliary centering for the axle in an axle cylinder is provided to prevent shifting of the axle within the cylinder when the axle carriers are removed. The steps of fixing the chainwheel sub-assembly to the auxiliary supports and subsequently shifting the axle to free the bearings constitute a method for bearing removal which does not require disassembly of the escalator/walkway conveying run and allows the escalator or walkway to be walked on during the exchange process.

8 Claims, 4 Drawing Sheets

EQUIPMENT AND METHOD FOR SIMPLIFIED ROLLER BEARING EXCHANGE AT ESCALATORS AND MOVING WALKWAYS

The present invention relates to escalators with a circulating step conveying run for the transport of persons between different levels, as well as to moving walkways with a circulating plate conveying run for horizontal conveyance of persons, such escalators and moving walkways substantially consisting of a support construction with side railings (balustrades), a step or plate conveying run, guides in the support construction for the conveying run, two respective circulating handrail belts and a drive station.

BACKGROUND OF THE INVENTION

A drive station for an escalator or moving walkway includes, for the drive of a long-link chain of the conveying run, two chainwheels, which are driven by a combination of roller chainwheels flange-mounted thereat, drive chains and a geared motor. The conveying run chainwheels are connected by a common hollow shaft. Pressed into the center of each conveying run chainwheel is a roller bearing which is seated by its inner race on a non-rotating central axle, the ends of which are fixed in axle carriers bolt-connected to the support construction. Such a sub-assembly described here is designated a "chainwheel sub-assembly" in the following.

Although "lubricated for life", such roller bearings utilized in chainwheel subassemblies are highly loaded by the operating forces experienced and are often exposed to a moist, corrosive atmosphere. Accordingly, they normally have to be changed several times in the course of the service life of the conveying equipment. In known embodiments of such escalators and moving walkways the change of the roller bearings requires complicated additional manipulations such as the separating of the conveying run and the drive chains, the lifting out of the chain sub-assembly from the support construction, as well as the reassembly of the demounted and separated components. An additional problem is that during this time the escalator cannot be walked on as a stairway.

BRIEF DESCRIPTION OF THE INVENTION

The change of roller bearings at the chainwheel sub-assembly of escalators and moving walkways is substantially simplified by the present invention, in particular that the conveying run no longer has to be separated and the chainwheel sub-assembly no longer has to be lifted out of the support construction. This is achieved by a support construction which has, on both sides of the drive station, auxiliary supports to which the chainwheel sub-assembly can be rigidly fixed at both ends by means of detachable connections, such as, for example, bolt connections with spacers or cotter pin connections. It is thereby made possible to remove the central axle carriers, which are bolt-connected with the support construction and which in the normal state prevent access to the roller bearings in the conveying run chainwheels, and to exchange the roller bearings according to a method in accordance with the invention. The escalator remains able to be walked on as a stairway during the roller bearing exchange.

The roller bearing exchange process according to the invention is as follows:

The long-link chains of the conveying run are so fastened to the support construction in the vicinity of the drive station by means of conventional chain-blocking devices whereby the drive station is relieved of chain tension. Thereafter, the above- described fixing and locking of the chainwheel sub-assembly relative to the support construction and the removal of the central axle carriers takes place. In order to be able to demount the now visible and accessible roller bearing installed at a first side conveying run chainwheel, the central axle of the chainwheel sub-assembly is axially drawn to the second side, such as with the assistance of a spindle puller fastened to the second side conveying run chainwheel such that the first side axle end leaves the inner race of the roller bearing which is to be demounted. The roller bearing is now withdrawn from the outer bearing seat in the chainwheel, such as by a commercial-type bearing extractor which is supported on the end face of the central axle locked by the spindle withdrawal device. In a next step a new roller bearing is pressed into the bore of the first side chainwheel by means of a spindle pressing-in device. For exchange of the second roller bearing, which is installed in the conveying run chainwheel at the second side, the process is reversed, whereby the central axle is subsequently pulled sufficiently to the first side that the inner race of the second side bearing now lies free and the bearing can be removed and replaced as above. Finally, the central axle is returned to its normal position. The central axle carriers are then remounted and the fixing of the chainwheel sub-assembly to the auxiliary supports of the support construction, as well as the chain-blocking devices, are removed. The installation is now ready again for operation.

BRIEF DESCRIPTION OF THE DRAWINGS

A fuller understanding of the present invention will be accomplished upon consideration of the following detailed description of a preferred, but nonetheless illustrative embodiment thereof when reviewed in connection with the annexed drawings, in which.

DETAILED DESCRIPTION OF THE INVENTION

Figure 1:
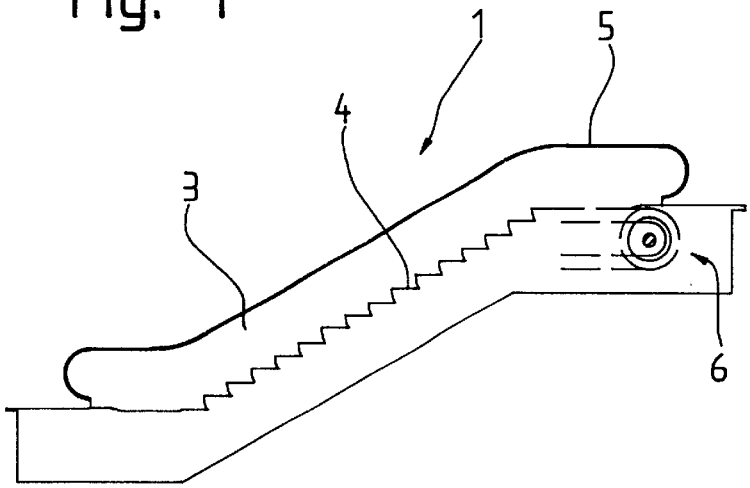
FIG. 1 shows schematically the arrangement of an escalator in accordance with the invention.

FIG. 1 shows schematically the essential elements of transport equipment for persons in accordance with the invention, i.e., in concrete terms an escalator 1, with a support construction 2, side railings (balustrades) 3, a step conveying run 4, circulating handrail belts 5, and a chain wheel sub-assembly 6 at a drive station. The invention relates to features in the region of the chainwheel sub-assembly, which is virtually identical in escalators and horizontal moving walkways.

Figure 2:
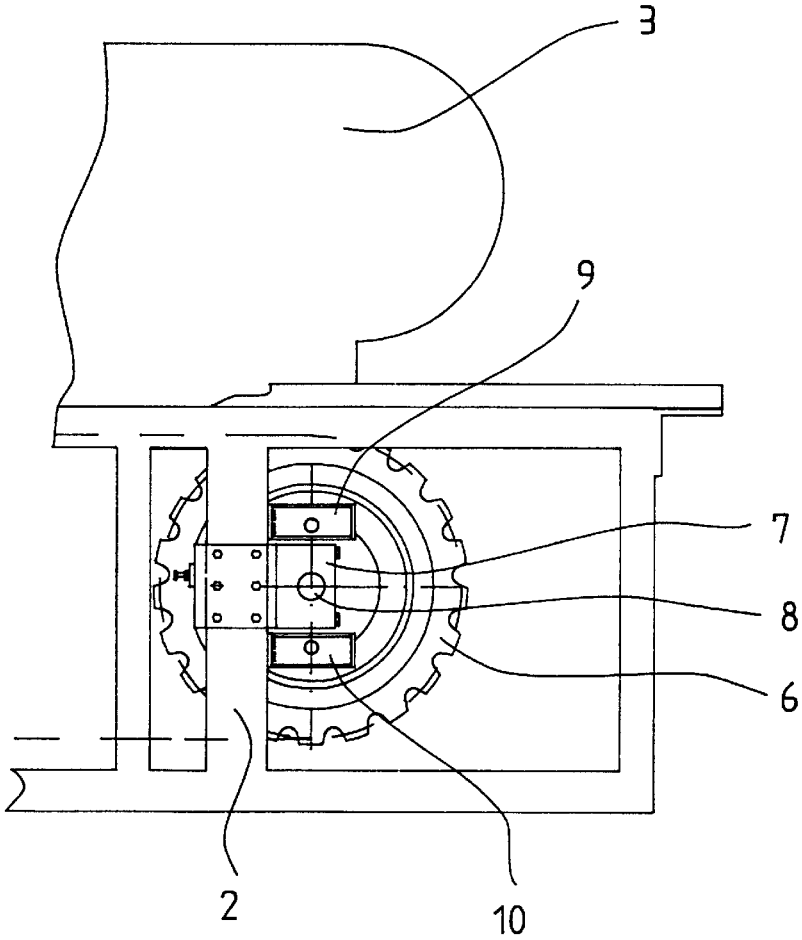
FIG. 2 shows a side view of a drive station of the elevator with a chainwheel sub-assembly.

In FIG. 2 there can be recognized in the side view the support construction 2, which is executed as a framework of the escalator, with central axle carriers 7 which are fastened to the support construction by means of bolt connections and which support a stationary central axle 8 of the chainwheel sub-assembly 6. Auxiliary supports 9 and 10, which serve for the fixing of the chainwheel sub-assembly described in the following, are mounted to the support construction above and below the central axle carriers 7. The chainwheel sub-assembly is provided with chain-blocking devices of a conventional nature by which, before the start of a roller bearing exchange process, the long-link chain runs of the conveying run can be so blocked in the vicinity of the drive station so that the chainwheel sub-assembly is relieved of chain tension.

Figure 3:
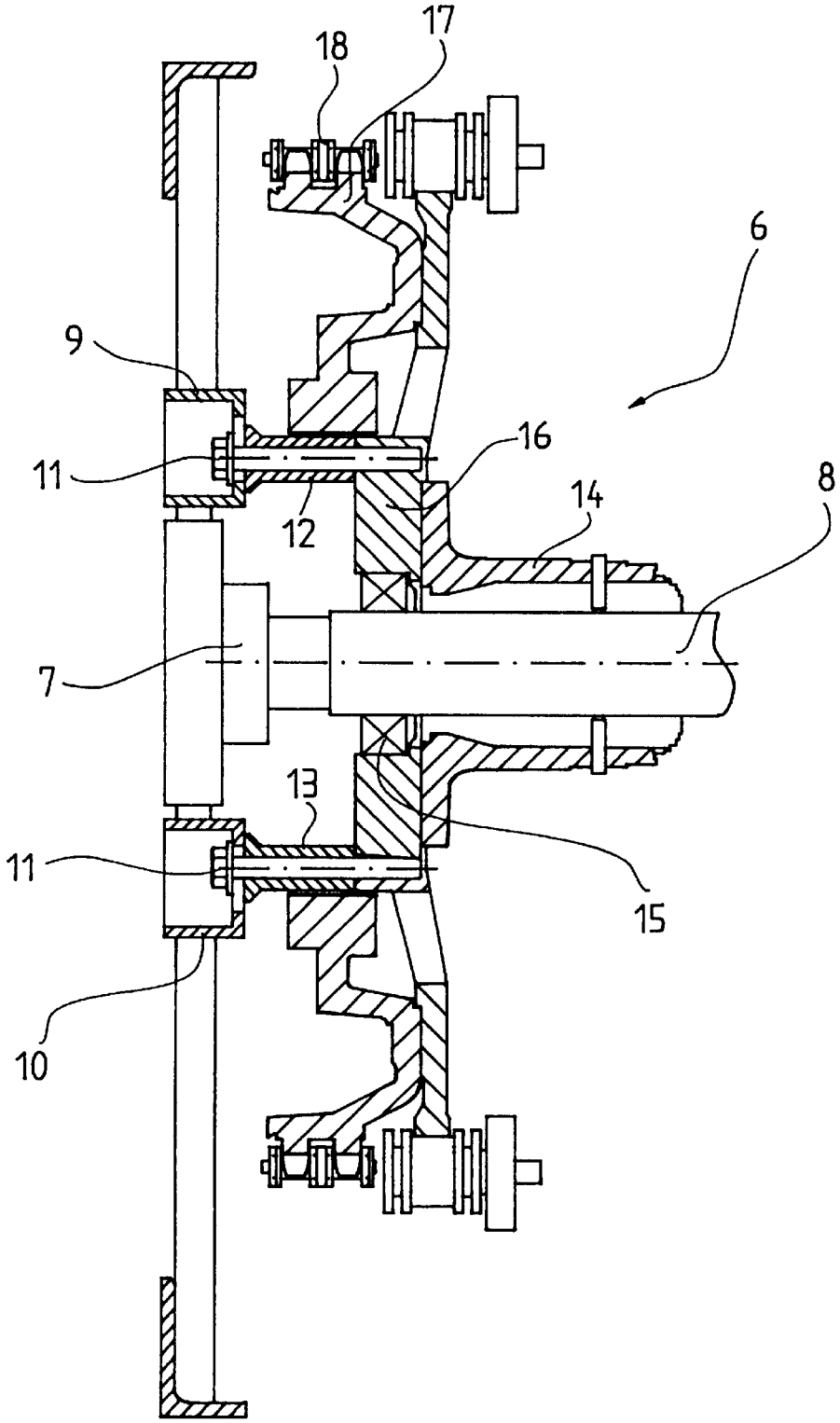
FIG. 3 shows a cross-section through the left-hand side of the chainwheel sub-assembly with its mountings to a support construction.

FIG. 3 illustrates the left-hand side part of the (symmetrical) chainwheel sub-assembly 6. The sub-assembly includes two conveying run chainwheels 16 which are connected together by a hollow shaft 14 and which are supported on the central axle 8 by way of roller bearings 15 pressed into accepting recesses in the chainwheels. The central axle has its ends in clamping bores of the central axle carriers 7, which are bolt-connected to the support construction. Roller chainwheels 17, which are flange-mounted to the conveying run chainwheels 16, engage with roller chains 18, by way of which the chainwheel sub-assembly is driven by a geared motor (not shown).

A first phase of the bearing exchange, in which the chainwheel sub-assembly has been rigidly connected to the support construction by means of bolts 11 through upper and lower spacers 12 and 13 is illustrated. The central axle carriers 7 are still mounted.

Figure 4:
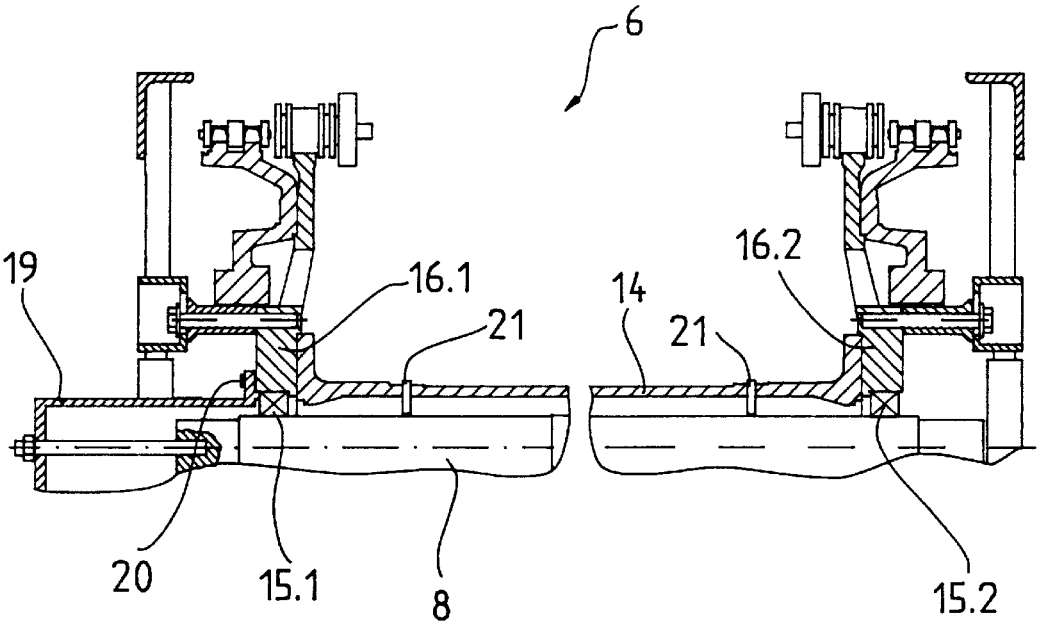
FIG. 4 shows a cross-section through the chainwheel sub-assembly after removal of the central axle carriers.

FIG. 4 shows a cross-section of the upper portion of the chainwheel sub-assembly after the next step of the process; removal of the central axle carriers 7, which as noted before, were bolt-connected to support construction. A spindle puller device 19 is shown which, for lateral withdrawal of the central axle 8, is then mounted to the conveying run chainwheel 16.1 by bolts 20.

Figure 5:
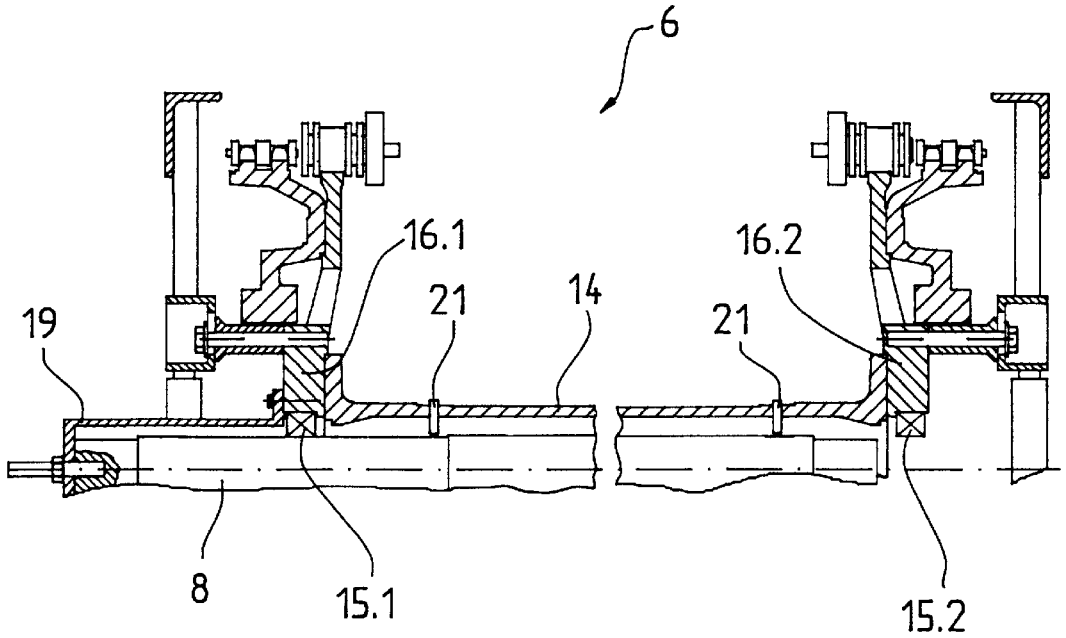
FIG. 5 shows a cross-section through the chainwheel sub-assembly after the displacement of the central axle.

In FIG. 5 a next phase of the bearing exchange is depicted, in which the central axle 8 is drawn sufficiently to the left by means of the spindle puller device 19 such that the inner race of the roller bearing 15.2 pressed into the conveying run chainwheel 16.2 at the right-hand side becomes accessible for a bearing extractor. Moreover, visible in the circumference of the hollow shaft 14 are two groups of at least three threaded pins 21, each group of which is arranged in a star or otherwise spaced shape and which, as seen in the figures, form an auxiliary centering means for the central axle, supporting the central axle when it is removed from the roller bearing. The pins are set to a suitable spacing for the central axle in the sub-assembly and fixed in place in the hollow shaft.

Figure 6:
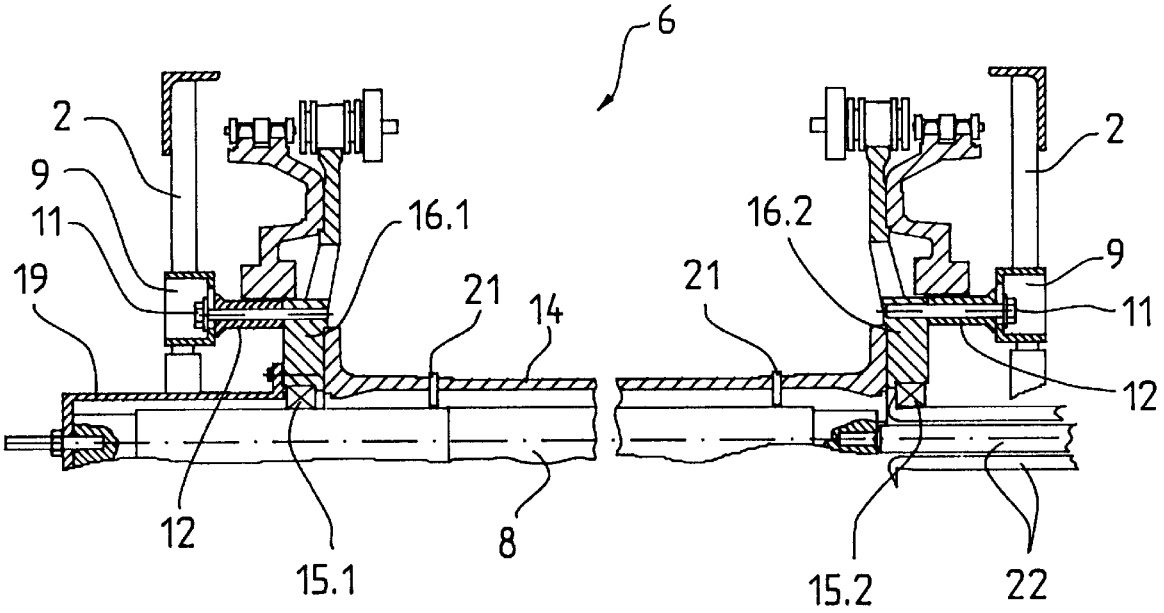
FIG. 6 shows a cross-section through the chainwheel sub-assembly during extraction of an old roller bearing.

FIG. 6 in turn shows the cross-section of the chainwheel sub-assembly illustrated in the subsequent phase of withdrawal of the old roller bearing 15.2 from its seat in the conveying run chainwheel 16.2. Seen is a bearing extractor 22, the hooks of which engage behind the inner race of the roller bearing and the pressure spindle of which presses against the end face of the central axle 8, which in turn is secured by the mounted spindle puller 19 against displacement by the force of the bearing extractor. The old roller bearing is removed and a new roller bearing is installed.

Figure 7:
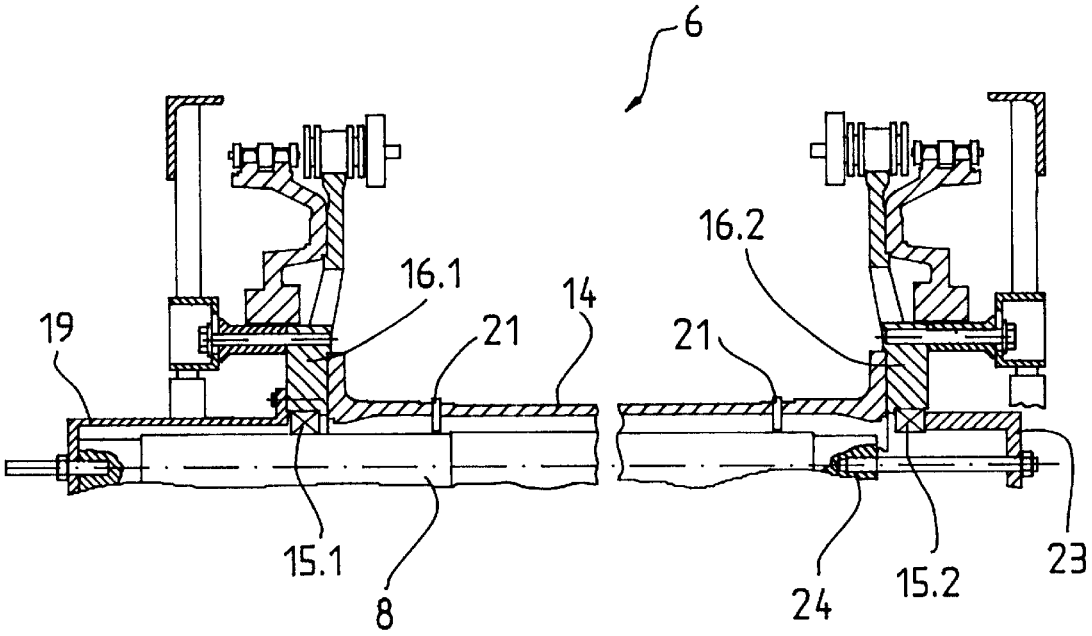
FIG. 7 shows a cross-section through the chainwheel sub-assembly during pressing in of a new roller bearing.

Depicted in FIG. 7, also a cross-section of the chainwheel sub-assembly, is how the new roller bearing 15.2 is pressed into the bore in the conveying run chainwheel with the assistance of a spindle pressing-in device 23 by pressure on the new roller bearing's outer race. The spindle of the pressing in device is screwed into an internal thread 24 in the end face of the central axle, which is still secured by the spindle puller 19 against displacement.

Once replacement of the right-hand bearing is accomplished, the axle is returned to its normal position and the spindle puller 19 is positioned at the right side of the sub-assembly. The foregoing procedure is repeated to withdraw the axle from the left-hand bearing, which is then removed and replaced. The axle is re-centered, and the central axle carriers re-installed. The sub-assembly is then freed from the spacers 12 and 13 by removal of the bolts 11, and tension is returned to the chainwheel sub-assembly. The escalator can then be returned to operation.

One skilled in the art will recognize that the methodology as set forth herein applies to the chainwheel sub-assemblies of moving walkways. Accordingly, the reference to escalators is deemed to refer to and include such moving walkways also.

I claim:

1. An escalator, comprising a circulating plate chain, a support construction with side railings, a step or plate conveying run driven by the circulating plate chain, circulating handrail belts and a drive station with a chainwheel sub-assembly supported by roller bearings mounted on a central axle, the ends of which are fixed in central axle carriers detachably connected to the support construction, wherein the support construction comprises auxiliary supports having means for the detachable fixing of the chainwheel sub-assembly.

2. The escalator according to claim 1, wherein the central axle carriers are detachably connected to the support construction by bolt connections.

3. The escalator or moving walkway according to claim 1 or 2, wherein the chainwheel sub-assembly includes a central axle located within a hollow shaft, the central axle being laterally displaceable to provide bearing extractor accessibility to inner races of the roller bearings.

4. An escalator or moving walkway according to claim 3, wherein the central axle of the chainwheel sub-assembly has internal threads at both end faces for the removable mounting of tools.

5. The escalator or moving walkway according to claim 3, wherein the chainwheel sub-assembly includes auxiliary centering means for the central axle, the auxiliary centering means comprising a plurality of groups of pins in the hollow shaft of the chainwheel sub-assembly.

6. A method for the simplified exchange of roller bearings in a chainwheel sub-assembly of a drive station of an escalator or moving walkway, wherein the chainwheel sub-assembly is supported by the roller bearings on a central axle fixed in a support construction, comprising the steps of: rigidly affixing the chainwheel sub-assembly to auxiliary supports of the support construction; removing central axle carriers; drawing the central axle to a first side of the chainwheel sub-assembly whereby a first end thereof is removed from an inner race of a roller bearing located on a second side of the chainwheel sub-assembly; withdrawing the roller bearing from the chainwheel sub-assembly; installing a new roller bearing in place of the roller bearing; and returning the central axle back to a central position.

7. The method of claim 6, wherein the step of installing the new roller bearing comprises the step of mounting a press tool upon the central axle through a threaded connection located in an end face of the central axle.

8. The method of claim 6 or 7 further including a final step of releasing the chainwheel sub-assembly from the auxiliary supports.

* * * * *